United States Patent [19]

Mackey

[11] Patent Number: 4,899,467

[45] Date of Patent: Feb. 13, 1990

[54] COMPOSITE OUTSOLE

[75] Inventor: Charles P. Mackey, Ava, Mo.

[73] Assignee: Forest A. Pruitt, Oklahoma City, Okla.

[21] Appl. No.: 226,240

[22] Filed: Jul. 29, 1988

[51] Int. Cl.[4] ..... A43C 15/02

[52] U.S. Cl. ..... 36/59 A; 36/59 R

[58] Field of Search ..... 36/4, 30 A, 30 R, 31, 36/59 A, 59 R, 103

[56] References Cited

U.S. PATENT DOCUMENTS

| | | | |
|---|---|---|---|
| 2,844,833 | 7/1958 | Odermatt | 36/59 A |
| 2,931,110 | 4/1960 | Pietrocola | 36/59 R |

FOREIGN PATENT DOCUMENTS

| | | | |
|---|---|---|---|
| 199541 | 6/1906 | Fed. Rep. of Germany | 36/59 A |
| 601278 | 11/1925 | France | 36/59 A |
| 120200 | 11/1947 | Sweden | 36/59 A |

*Primary Examiner*—Werner H. Schroeder
*Assistant Examiner*—Diana L. Biefeld
*Attorney, Agent, or Firm*—Dennis T. Griggs

[57] ABSTRACT

A composite outsole for a shoe includes a leather sole piece, an inner sole bonded to the outsole and a back plate interleaved between the inner sole and the outsole and at least partially embedded within the outsole in a region substantially coextensive with the ball support area of the sole. Multiple pockets are formed in the tread surface of the outsole and are spaced apart substantially within the ball support region. Each pocket is filled by a stud which is integrally formed with the back plate. Each stud is characterized by a large diameter portion having an external wear surface disposed substantially flush with the external tread surface of the leather outsole, and a small diameter portion which links the large diameter portion with the back plate.

4 Claims, 4 Drawing Sheets

COMPOSITE OUTSOLE

FIELD OF THE INVENTION

This invention relates generally to footwear and more particularly to a composite outsole for shoe or boot.

DESCRIPTION OF THE PRIOR ART

The traditional material used to form the outsole for a shoe is natural leather. Leather is the preferred material because of its flexibility, the gripping ability of its tread surface, and its general durability when exposed to severe wear conditions. Attempts have been made to simulate the properties of natural leather by a molded polymer outsole. A nylon outsole, for example, has superior abrasion resistance but is not as supple or resilient as natural leather over a wide range of wear conditions. Therefore, because the overall combination of properties of natural leather is superior to man-made materials, natural leather continues to be the preferred material for outsole construction.

The region of the leather outsole which is subjected to intensive wear and abrasion is the external tread surface which supports the ball of the foot. This generally oval region is the first to wear out in a natural leather outsole, while the remainder of the outsole remains serviceable. However, the shoe cannot be worn comfortably in such a condition. The usual remedy is to replace the worn sole with a new half sole. Although this procedure is relatively simple, its cost is typically one-fourth to one-third the value of a new pair of shoes.

OBJECTS OF THE INVENTION

It is, therefore, the principal object of the present invention to provide a composite outsole for a shoe in which the ball region of a leather outsole is reinforced by a durable material such as a polymer resin, with the composite sole having substantially the same flexibility and suppleness of natural leather, but having improved durability.

The general object of the invention is to provide a composite leather outsole for a shoe in which the ball supporting region is reinforced for improved durability.

SUMMARY OF THE INVENTION

The outsole of the invention includes a leather sole piece, an inner sole bonded to the outsole and a back plate interleaved between the inner sole and the outsole in a region substantially coextensive with the ball support area of the sole. The outsole is perforated with multiple openings which are spaced apart substantially within the ball support region and are filled by multiple studs which are integrally formed with the back plate. The studs are stabilized by the back plate and by the outsole body portion surrounding the perforations. In the preferred embodiment, the back plate is disposed substantially flush with the inner support surface of the leather sole piece, and the studs are provided with external wear surfaces which are disposed substantially flush with the tread surface of the leather sole piece.

In the preferred embodiment, each stud is characterized by a large diameter portion having an external wear surface disposed substantially flush with the tread surface of the leather outsole, and a small diameter portion which links the large diameter portion with the back plate. Because the studs are integrally formed with the back plate, and in view of the lateral support provided by the outsole body portion which surrounds each stud, it will be appreciated that the studs are stabilized against lateral and vertical displacement. Moreover, the back plate and the adjoining outsole uniformly distribute the load forces transmitted by the studs, thereby avoiding the usual discomfort associated with outsoles which are equipped with external cleats.

The novel features which characterize the invention are defined by the appended claims. The foregoing and other objects, advantages and features of the invention will hereinafter appear, and for purposes of illustration of the invention, but not of limitation, an exemplary embodiment of the invention is shown in the appended drawings.

DETAILED DESCRIPTION OF THE PREFERRED EMBODIMENTS

Figure 1:
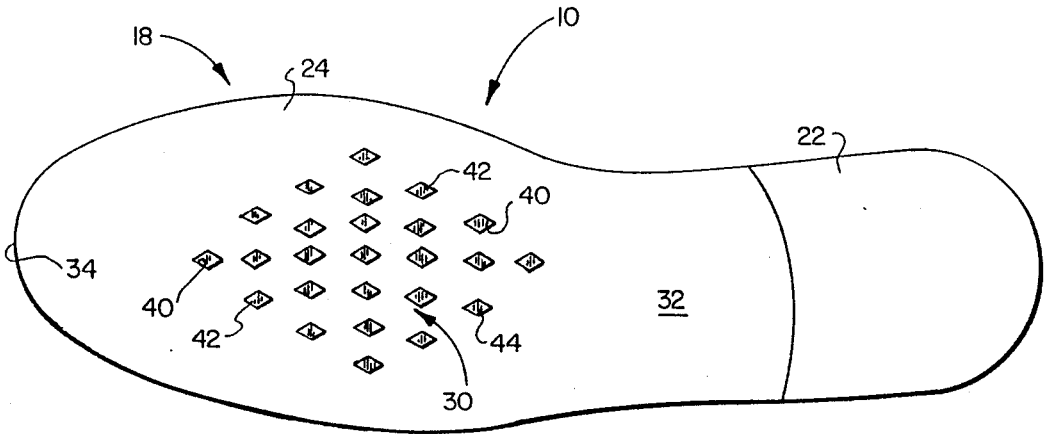
FIG. 1 is a bottom plan view of a shoe having an outsole constructed according to the invention.

In the description which follows, like parts are marked throughout the specification and all figures of the drawing with the same reference numerals, respectively. The drawings are not necessarily to scale, and in some instances, proportions have been exaggerated in order to more clearly depict certain features of the invention.

Figure 2:
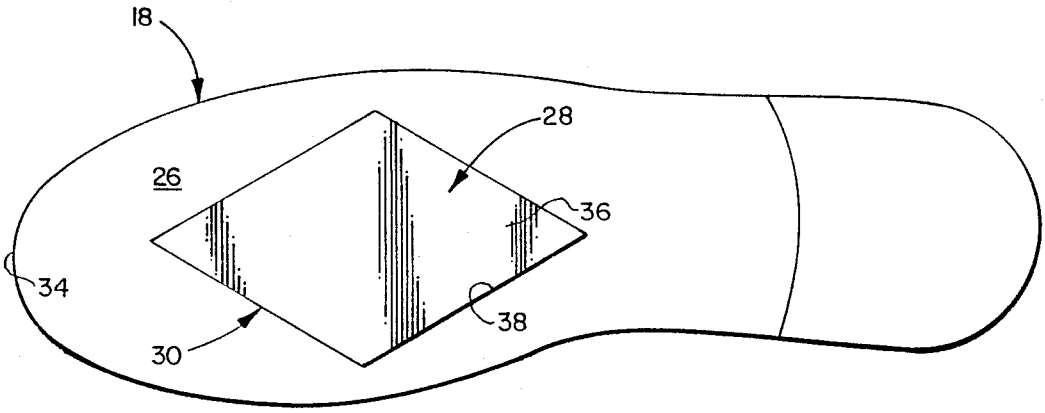
FIG. 2 is a top plan view of the outsole shown in FIG. 1.
Figure 3:
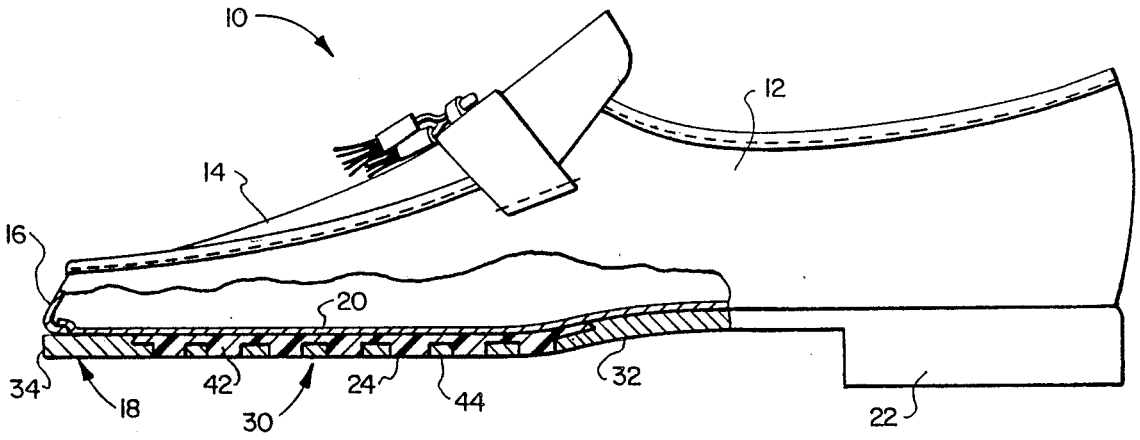
FIG. 3 is a side elevation view, partly in section, of the shoe shown in FIG. 1.

Referring now to FIGS. 1, 2 and 3, a shoe 10 has a leather side panel 12, an upper panel 14, a toe covering 16 and a composite outsole 18. The side panel 12 and toe covering 16 are stitched onto the outsole 18 in the usual manner. Permanently bonded to the outsole 18 is an inner sole 20. A rubber heel 22 is secured to the under-side of the outsole 18 at the rear of the shoe 10 in the usual manner.

The composite outsole 18 is constructed of natural leather and is provided with a tread surface 24 and an inner foot support surface 26. The inner sole 20 is superimposed onto the inner support surface 26 of the outsole 18. The inner sole 20, side panel 12 and toe covering 16 are assembled onto the outsole 18 by the usual welt handling steps including welt sewing, welt beating and outsole stitching, as well as the usual rough rounding, edge trimming and wheeling operations.

Referring now to FIG. 3, a back plate 28 is interposed between the inner sole 20 and the outsole 18. The back plate 28 is partially embedded within the outsole 18 in a region substantially within the ball support area 30 which lies intermediate the arch 32 and the toe region 34. The interior side surface 36 of the back plate 28 is disposed substantially in coplanar relationship with the inner foot support surface 26. The back plate 28 is received within an open cavity 38. The open cavity 38 is cut into the inside wear surface 26 of the outsole 18, and as can best be seen in FIG. 2, it is in the form of an oblique parallelogram. The outsole body portion is undercut around the periphery 38A of the cavity 38 thereby forming a wedge lock with the edge 28A of the back plate 28.

According to one aspect of the invention, the outsole 18 is perforated by multiple openings 40 which are spaced apart substantially within the ball support region 30. Multiple studs 42 are integrally formed with the back plate 28 and are received within the perforations 40.

Preferably, the back plate 28 and the studs 42 are integrally formed of a moldable material such as a polyamid resin. Other materials including nylon, PVC or other elastomeric compound, such as vinyl chloride-vinyl acetate copolymer, a vinyl chloride-vinylidene chloride copolymer, or mixtures hereof, can be used to good advantage. When the resin material has been injected into the open cavity 38 and into the perforations 40, the cavity and perforations are filled with the resin material which becomes embedded therein, thereby defining the multiple studs 42 in the perforations 40 and the back plate 28 within the cavity 38.

The perforations 40 preferably have a diamond cross-section and are uniformly spaced throughout the ball support region 30. The studs 42 project through the body portion of the leather outsole 18. The external wear surface 44 of each stud is disposed substantially in coplanar, flush relationship with the outsole tread surface 24 within the ball support area 30.

Figure 4:
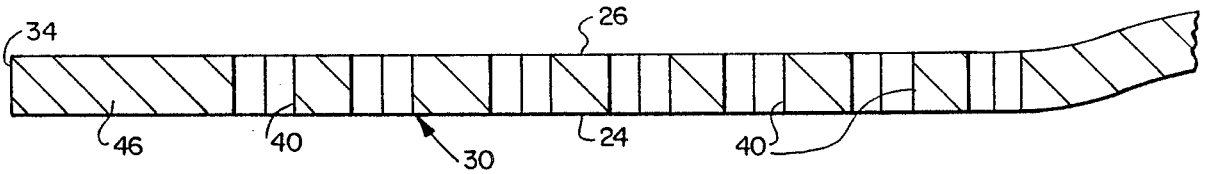
FIG. 4 is a sectional view which illustrates one step in the fabrication of the composite outsole of the invention.
Figure 5:
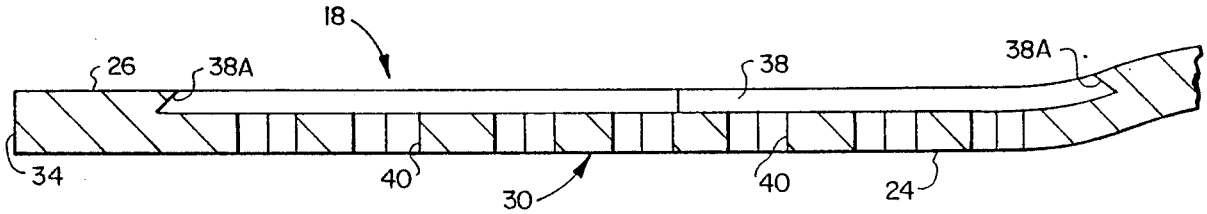
FIG. 5 is a sectional view similar to FIG. 4 which illustrates a second step in the fabrication of the composite outsole.
Figure 6:
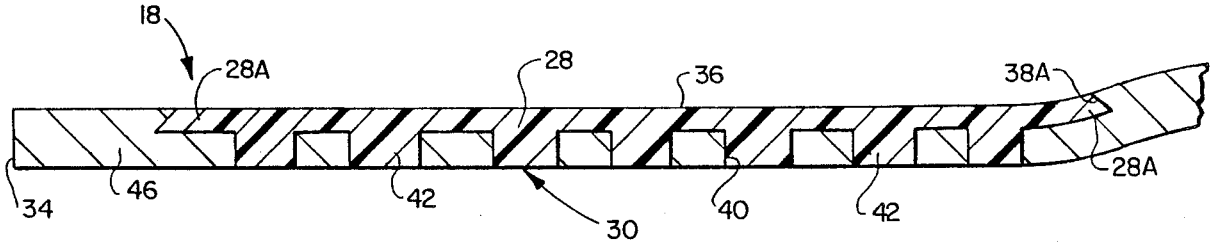
FIG. 6 is a sectional view similar to FIG. 5 which illustrates a third step in the fabrication of the composite outsole.

Referring now to FIGS. 4, 5 and 6, the composite outsole 18 is fabricated from a precut natural leather sole piece 46 of the appropriate outsole dimensions. The sole piece 46 is perforated within the ball support region 30 to form an array of diamond shaped openings 40 according to the pattern shown in FIG. 1. The perforations 40 extend completely through the body of the precut leather piece 46 and intersect the outside tread surface 24 and inside wear surface 26. Although the diamond cross-section is preferred, other cross-sectional forms such as circles, ovals, triangles or rectangles may be used to good advantage.

Next, the open cavity 38 is cut into the upper body portion of the precut leather piece 46. The open cavity 38 has an overall diamond-shaped appearance, and has a depth of approximately fifteen to twenty percent of the thickness of the precut leather piece 46. The outsole edge is undercut as can best be seen in FIGS. 5 and 6 whereby the injected back plate edge 28A forms a wedge interlock with the undercut outsole rim 38A.

After the precut leather sole piece 46 has been perforated and the open cavity 38 has been formed, it is placed into an injection mold. Thereafter, the resin material is injected under pressure into the open cavity 38 and perforations 40 whereby the back plate 28 and integral studs 42 become firmly embedded within the cavity and perforations of the precut leather sole piece 46, thereby producing the composite outsole 18.

The composite outsole is subsequently attached to the bottom of a lasted shoe by the usual outsole stitching method. It will be appreciated, however, that the composite outsole unit herein described may be manufactured and sold separately as an article of commerce.

Because the studs 42 are integrally formed with the back plate 28, and in view of the lateral support provided by the outsole body portion 46 which surrounds the studs, it will be appreciated that the studs 42 are stabilized against lateral and vertical displacement. The outsole tread surface 24 which lies generally within the ball support area 30 is protected from abrasive wear by the support action of the studs 42 which have a relatively durable wear surface 44. The thickness of the back plate 28 is maintained at a relatively small percentage of the thickness of the outsole body portion 46, thereby substantially preserving the overall flexibility of the outsole. The oblique parallelogram contour of the back plate 28, as illustrated in FIG. 2, provides good flexibility characteristics for the composite outsole 18. The back plate 28 also uniformly distributes the load forces transmitted by the studs 42, thereby avoiding the usual discomfort associated with outsoles which are equipped with external cleats.

Referring now to FIGS. 7, 8, 9 and 10, the outsole piece 46 is perforated within the ball support region 30 to form an array of cylindrical cavities 48 which are spaced apart substantially within the ball support area 30 of the outsole. The outsole body portion surrounding each cavity 48 is undercut thereby defining a back plate pocket 50. An injection body of resin material is disposed with each perforation opening 48 and pocket 50 thereby defining an integrally formed stud 52 and back plate 54 within each cavity 48 and pocket 50, respectively.

Figure 7:
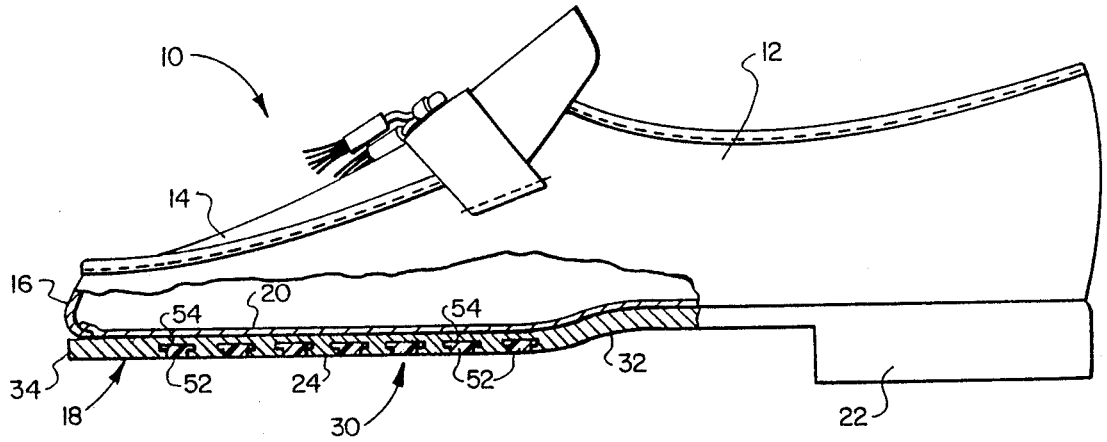
FIG. 7 is a side elevation view, partly in section, of a shoe having an outsole constructed according to an alternate embodiment.
Figure 8:
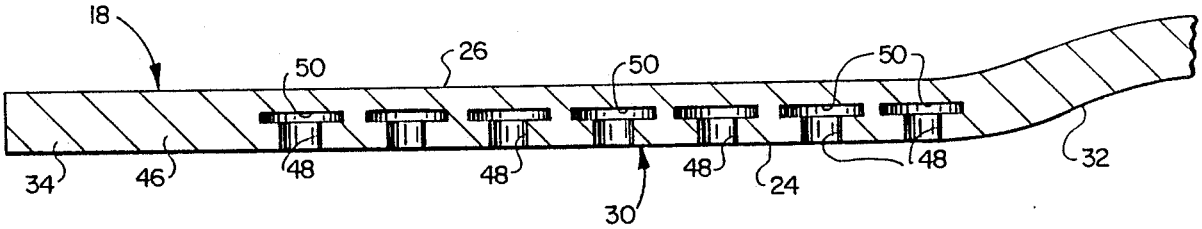
FIG. 8 is a sectional view which illustrates one step in fabrication of the composite outsole illustrated in FIG. 7.
Figure 10:
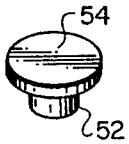
FIG. 10 is a perspective view of an integrally formed stud and back plate.
Figure 9:
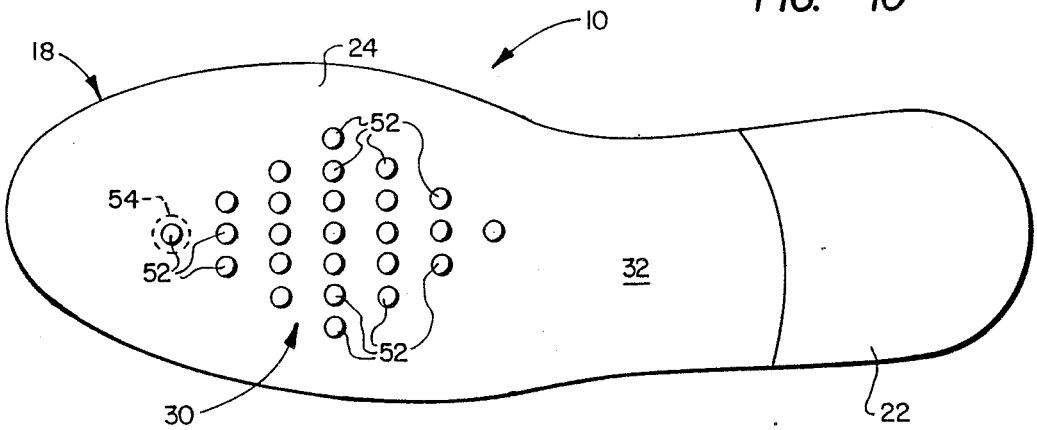
FIG. 9 is a bottom plan view of a shoe having an outsole constructed according to an alternate embodiment of the invention.
Figure 11:
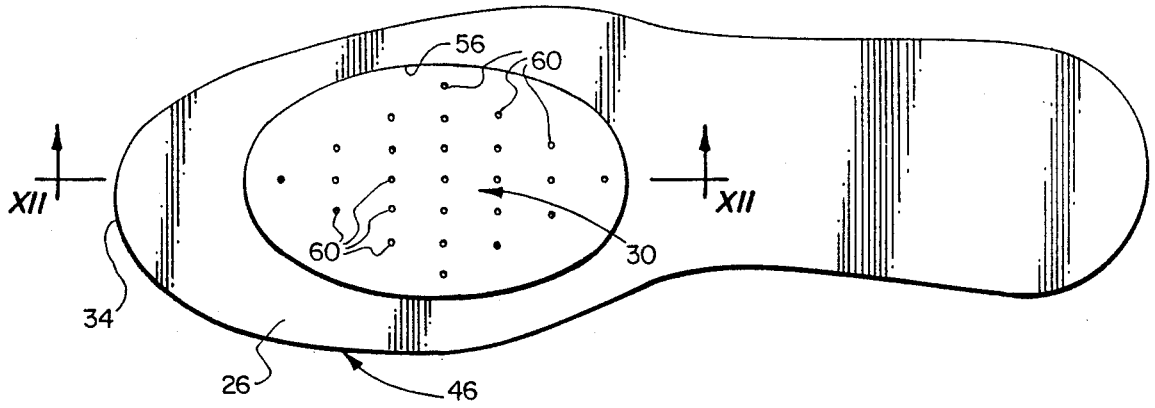
FIG. 11 is a top plan view of an outsole fabricated according to an alternate embodiment of the invention.

The stud cavities 48 are cylindrical and extend only partially into the thickness of the outsole body portion 18. Each cavity 48 is a blind bore which is enlarged by the undercut back plate bore 50. After the precut leather sole piece 46 has been perforated with the cylindrical stud openings and back plate openings formed, it is placed into an injection mold. Thereafter, the resin material is injected under pressure into the open stud and back plate cavities thereby producing the integral stud and back plate combination illustrated in Figure 10. The integrally formed studs 52 and back plates 54 are firmly embedded within the precut leather sole piece 46, thereby forming the composite outsole 18 as illustrated in FIGS. 7 and 9.

Because each stud 52 is integrally formed with a back plate 54, and in view of the lateral support and vertical support provided by the outsole body portion 46 which surrounds the studs and back plates, it will be appreciated that the studs 52 are stabilized against lateral and vertical displacement. The outsole tread surface 24 which lies generally within the ball support area 30 is protected from abrasive wear by the relatively durable wear surface of each stud 52 which is flush with the outsole tread surface. The back plates 54 uniformly distribute the load forces transmitted by the studs 52, thereby avoiding the usual discomfort associated with outsoles which are equipped with external cleats.

Referring now to FIGS. 11, 12, 13 and 14, an alternate embodiment of the composite outsole 18 is illustrated. The composite outsole 18 is fabricated from a precut natural leather sole piece 46 of the appropriate outsole dimensions. As in the previous embodiment, the precut leather sole piece 46 is provided with an outsole tread surface 24 and an inner foot support surface 26. A portion of the outsole body 46 is removed through the inner support surface 26 to form a shallow, oval depression 56 in which the back plate 28 is injected. The portion of the leather sole piece underlying the shallow depression 56 is intersected by multiple pockets 58 extending through the outside tread surface 24 and partially into the body portion 46. Each pocket is in the form of a hemispherical opening which penetrates to a depth equal to approximately one-half of the thickness of the precut leather piece 46. The body portion of the precut leather sole piece 46 which lies intermediate the oval depression 56 and each hemispherical pocket is performed by an injection passage 60.

Figure 12:
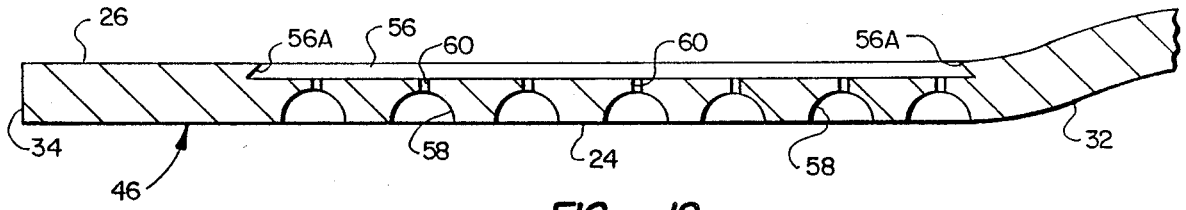
FIG. 12 is a sectional view of the outsole shown in FIG. 11 taken along the lines XII—XII.
Figure 13:
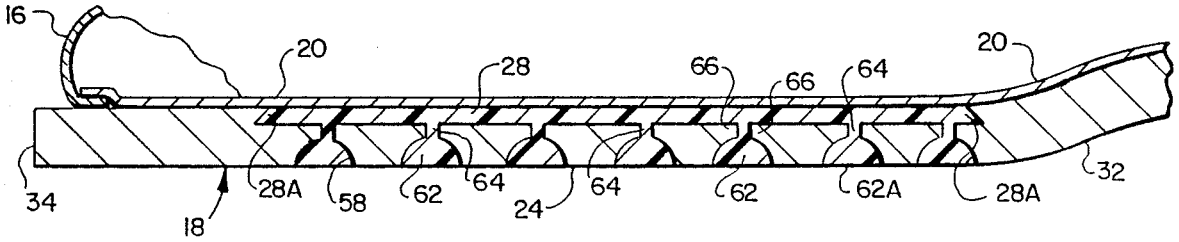
FIG. 13 is a sectional view similar to FIG. 12 which illustrates a second step in the fabrication of an alternate embodiment; and, FIG. 14 is a bottom plan view of the outsole illustrated in FIG. 13.
Figure 14:
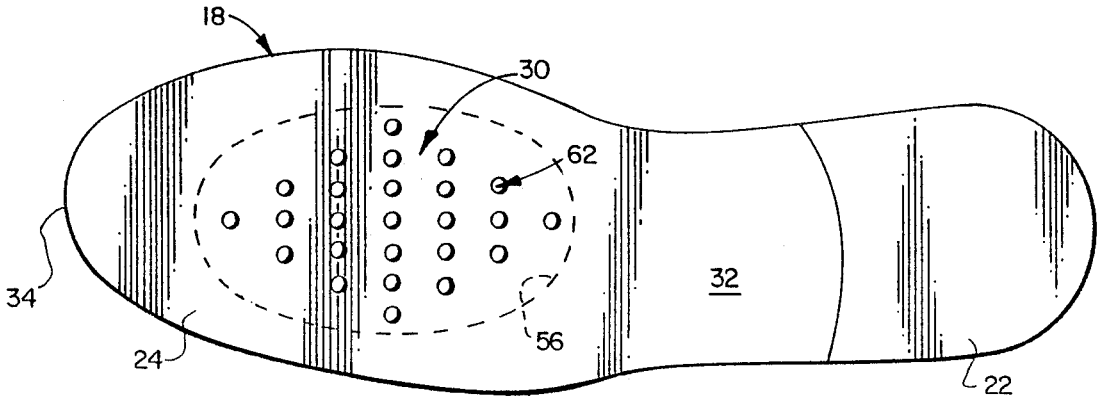

The oval depression 56 has a depth of approximately fifteen to twenty percent of the thickness of the precut leather piece 64. The outsole body portion along the periphery of the oval depression 56 is undercut to form a rim 56A as best can be seen in FIGS. 12 and 13.

After the precut leather sole piece 46 has been perforated and the oval depression 56 has been formed, it is placed into an injection mold. Thereafter, resin material is injected under pressure into the oval depression, perforation 60 and hemispherical pockets 58 thereby defining the back plate 28, studs 62 and links 64. The injected back plate edge 28A forms a wedge interlock with the undercut outsole rim 56A.

Preferably, the back plate 28 is formed flush with the inner foot support surface 26, and each stud 62 is provided with an external tread surface 62A which is substantially flush with the outsole tread surface 24.

The back plate 28 is stabilized as a result of the wedge interlock produced by the coupling of the back plate edge 28A with the undercut outsole rim 56A. Since the studs 62 and links 64 are integrally formed with the back plate 28, the studs 62 are stabilized against vertical displacement. The studs 62 are further stabilized against lateral displacement as well as vertical displacement by the body portion of the leather sole piece which surrounds the pocket 58, which lies intermediate the pocket 58 and the back plate 28. Thus, the load force transmitted by each stud 62 is reacted by the leather sole piece as well as by the back plate 28, thereby avoiding the usual discomfort associated with outsoles which are equipped with external cleats.

The invention may be embodied in other specific forms without departing from the spirit or essential characteristics thereof. For example, although the back plate 28 is preferably embodied in the form of a diamond or oval, other back plate configurations, such as rectangular strips, for example, may be used to good advantage. Likewise, although the stud elements 42 are preferably embodied with a diamond or circular cross-section, other goemetrical cross-sections such as ovals, triangles, rectangles and the like may be used to good advantage. Therefore, the present embodiment should be considered in all respects as illustrative and not restrictive, the scope of the invention being indicated by the appended claims rather than by the foregoing description. All changes that come within the meaning and range of equivalency of the claims are therefore intended to be comprehended by the claims.

What is claimed is:

1. A composite outsole for a shoe comprising a sole piece having a body portion, an outsole tread surface formed on one side of said body portion and an inner support surface formed on the opposite side of said body portion, said body portion having multiple stud cavities intersecting said outside tread surface and extending partially into said body portion within a ball support region, said outsole body portion surrounding each stud cavity being undercut thereby defining a counterbore pocket in communication with said cavity, and an injection body of resin material embedded within each cavity and in each counterbore pocket, respectively, thereby defining a stud and a back plate in each pocket, with each stud and back plate being integrally formed together.

2. An outsole for a shoe as defined in claim 1, each back plate having an oval periphery.

3. An outsole for a shoe as defined in claim 1, each back plate having a thickness in the range of approximately fifteen to twenty percent of the thickness of said outsole.

4. An outsole for a shoe as defined in claim 1, said studs being uniformly spaced within the ball support region, and each stud having a circular cross section.

* * * * *